US006095261A

United States Patent [19]

Trevino, Jr.

[11] Patent Number: 6,095,261

[45] Date of Patent: Aug. 1, 2000

[54] DRILL BIT REVERSE CIRCULATION APPARATUS AND METHOD

[75] Inventor: Joe Trevino, Jr., Mansfield, Tex.

[73] Assignee: Baker Hughes Incorporated, Houston, Tex.

[21] Appl. No.: 09/121,142

[22] Filed: Jul. 23, 1998

[51] Int. Cl.[7] ..... E21B 10/18; E21B 21/12

[52] U.S. Cl. ..... 175/57; 175/215; 175/339

[58] Field of Search ..... 175/339, 324, 175/213, 215, 171, 57, 340, 393

[56] References Cited

U.S. PATENT DOCUMENTS

| | | | |
|---|---|---|---|
| Re. 27,316 | 3/1972 | Elenburg | 175/339 |
| 2,887,301 | 5/1959 | Day . | |
| 3,416,618 | 12/1968 | Kunnemann | 175/339 |
| 3,439,757 | 4/1969 | Elenburg . | |
| 3,948,330 | 4/1976 | Langford, Jr. | 175/339 |
| 3,958,651 | 5/1976 | Young | 175/340 |
| 4,100,981 | 7/1978 | Chaffin | 175/60 |
| 4,102,418 | 7/1978 | Kammerer, Jr. | 175/324 |
| 4,187,920 | 2/1980 | Johnson | 175/267 |
| 4,219,087 | 8/1980 | Johnson | 175/215 |
| 4,293,048 | 10/1981 | Kloesel, Jr. | 175/340 |
| 4,516,633 | 5/1985 | Richardson et al. | 166/69 |
| 4,741,406 | 5/1988 | Deane et al. | 175/340 |
| 4,823,890 | 4/1989 | Lang | 175/318 |
| 4,848,476 | 7/1989 | Deane et al. | 175/340 |
| 5,125,464 | 6/1992 | Sabatier | 175/135 |

*Primary Examiner*—David Bagnell
*Assistant Examiner*—Joselynn Z. Sliteris
*Attorney, Agent, or Firm*—Felsman, Bradley, Vaden, Gunter & Dillon, L.L.P.; James E. Bradley

[57] ABSTRACT

An improved bit body for a tri-cone drill bit has a bit body affixed to a terminal end of drilling string. The drilling string has at least one fluid passageway formed in its wall. The drilling string is dual passage drilling string formed of an inner drilling string and an outer drilling string. The terminal end of the inner drilling string has an area of reduced outer diameter. A cylindrical shroud is affixed to the drilling string and surrounds the area of reduced diameter and an upper portion of bit body, forming a shroud chamber. The shroud chamber communicates the fluid passageway of the drilling string with the fluid ports of the bit body. The lower edge of the shroud is closely spaced to an outer diameter portion of the drill bit body adjacent the recesses. Therefore, the shroud and recesses form fluid ports through which fluid may be directed to cool and remove debris from the roller cutters.

13 Claims, 3 Drawing Sheets

DRILL BIT REVERSE CIRCULATION APPARATUS AND METHOD

TECHNICAL FIELD

This invention relates to a rotary drill system and more particularly to a drill bit adapted for use with a dual passage drilling string, where the drill bit includes fluid ports for delivering fluid proximate roller cutters, and where the fluid ports are defined by a cylindrical shroud and recesses in the outer diameter of the bit body.

BACKGROUND OF THE INVENTION

In certain mining operations, dual passage drill strings are employed to drill shafts. A rolling cutter bit is mounted to the drill string. A circulating fluid, typically air, is pumped down the annulus of the drill string and out nozzles. The air returns up a central passage along with cuttings. The nozzles are circular cross section jets mounted between each bit leg. An advantage of a dual passage drill string is that drilling fluid is circulated through conduits of fixed uniform cross-section to produce cutting recovery, cooling and lubrication of the drill bit. It is important to direct a fluid flow across the roller cutters of a bit to cool the cutters and to prevent materials from building up on the cutters. While successful, improvements in the delivery of air across the cutters is desired.

BRIEF SUMMARY OF THE INVENTION

This invention is a rotary drill system for drilling a well bore wherein the drill system includes a dual passage drilling string having a terminal end and a central bore. The terminal end of the drilling string has at least one fluid passageway extending downward through the annulus between the inner and outer drilling strings. A bit body is detachably secured to the terminal end of the drilling string. The bit body has three downwardly extending legs to which are attached inwardly extending roller cutters. The bit body has a central passageway for communication with the central bore of the drilling string for returning drilling fluid to the surface.

A recess is formed on an outer diameter of the bit body between each of the legs. A cylindrical shroud is affixed to the terminal end of the drilling string and surrounds an upper portion of the bit body. The cylindrical shroud surrounds a portion of the bit body, which has an area of reduced diameter. The shroud and the area of reduced diameter define a shroud chamber that communicates with the fluid passageway at the upper end of the shroud chamber. The shroud has a lower edge which is closely spaced to the legs of the bit body and the recesses. The shroud and recesses define fluid ports that are in communication with a lower end of the shroud chamber. The fluid ports are designed to provide an increased flow to the roller cutters of the drill bit.

DETAILED DESCRIPTION OF THE INVENTION

Figure 1B:
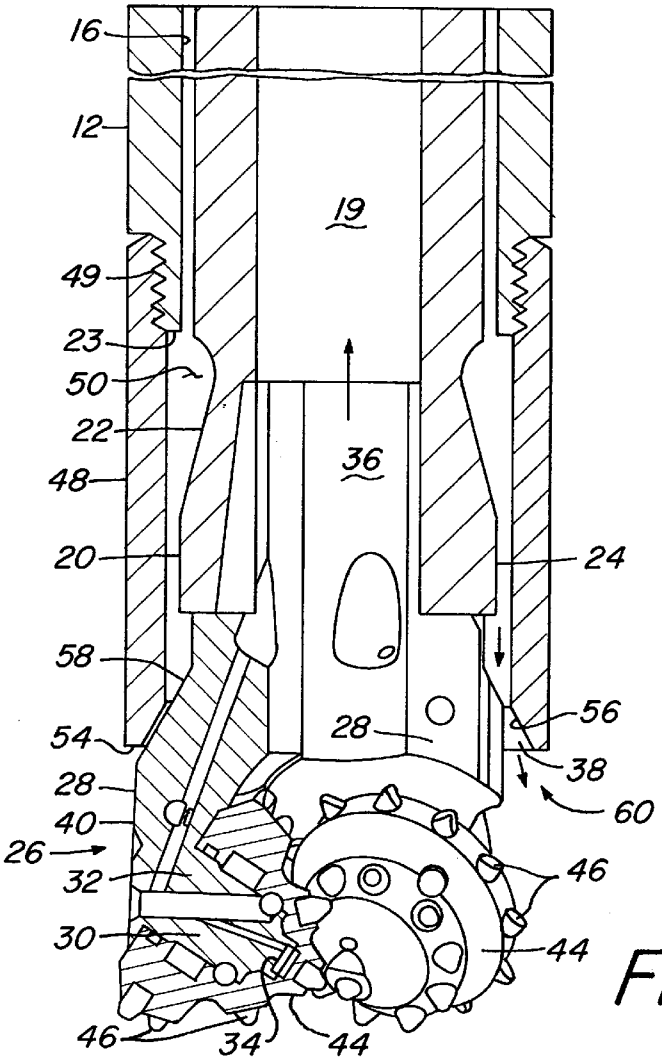
FIG. 1*b* is a partial cross-sectional view of a rotary drilling apparatus in accordance with the invention.
Figure 1A:
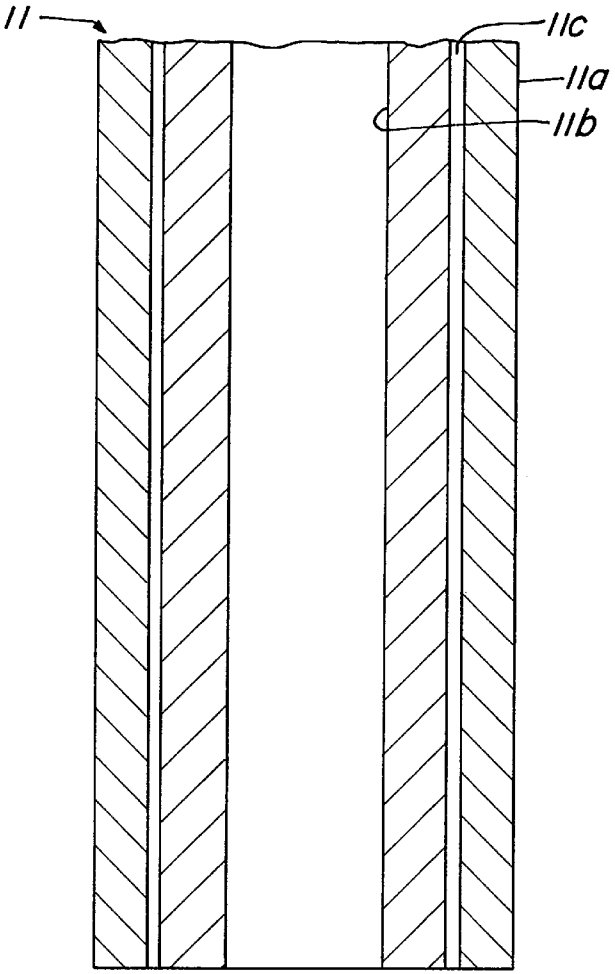
FIG. 1*a* is a cross-sectional view of a dual passage drill string.
Figure 2:
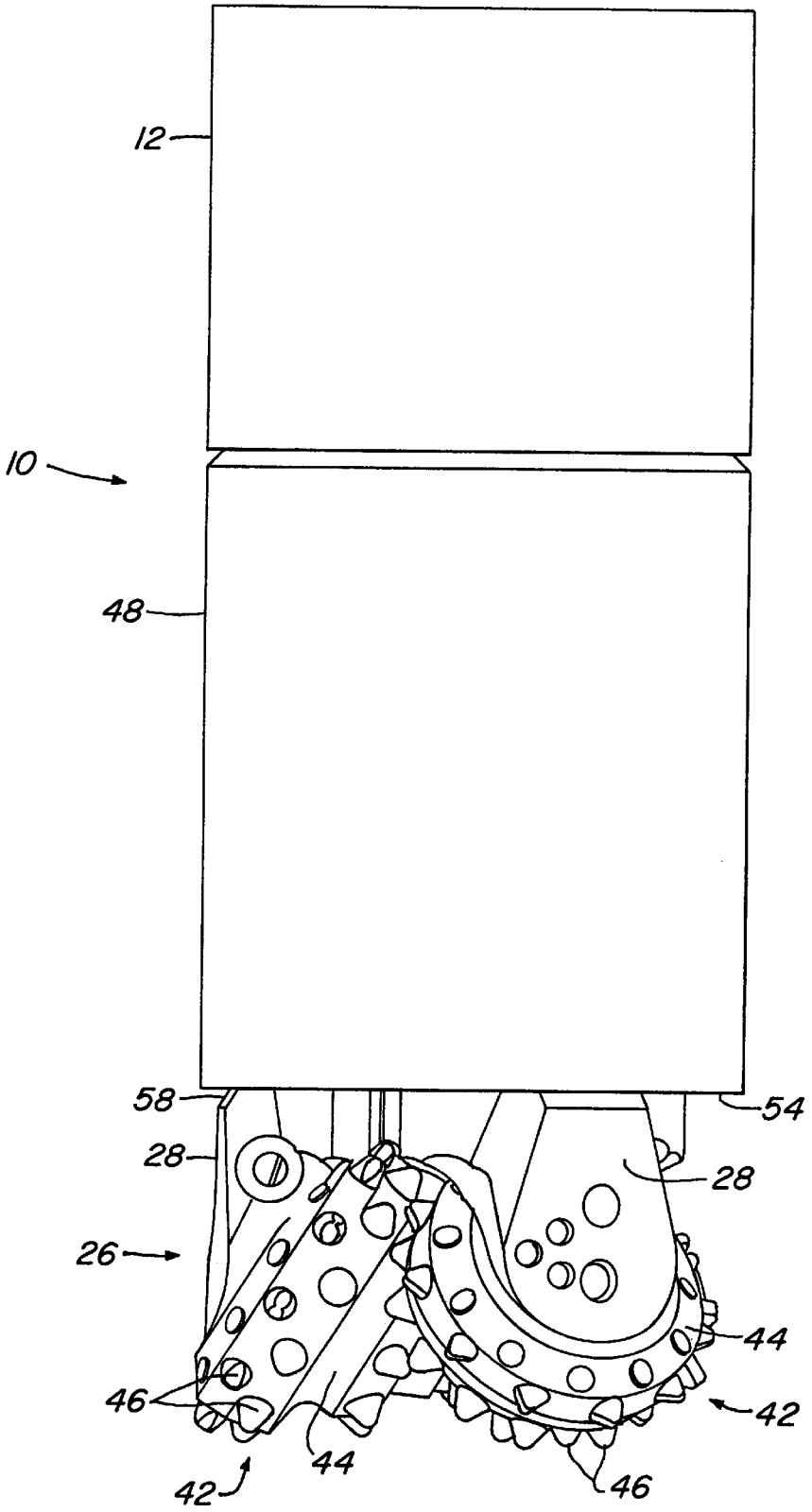
FIG. 2 is an elevational view of the rotary drilling apparatus of FIG. 1.
Figure 3:
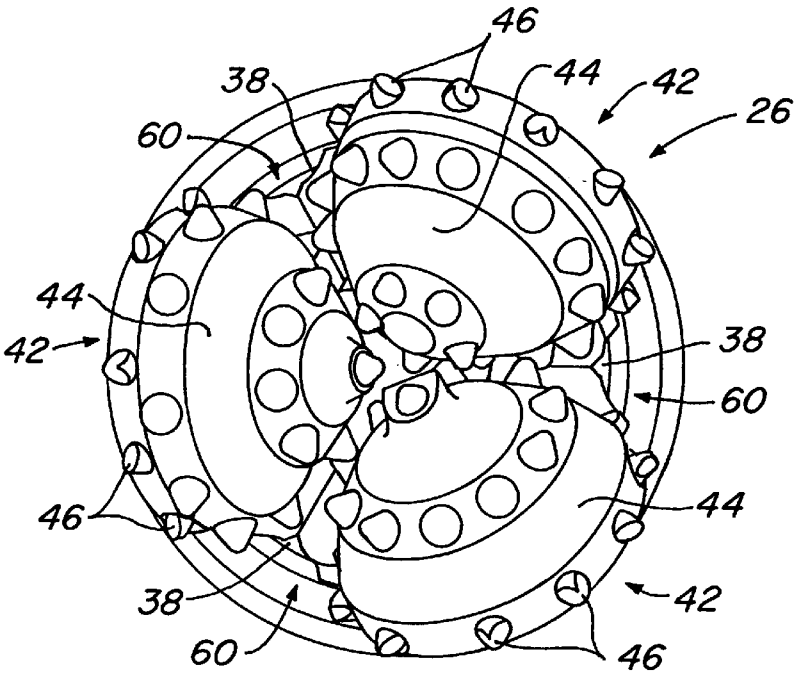
FIG. 3 is a lower end view of the rotary drilling apparatus of FIG. 1.
Figure 4:
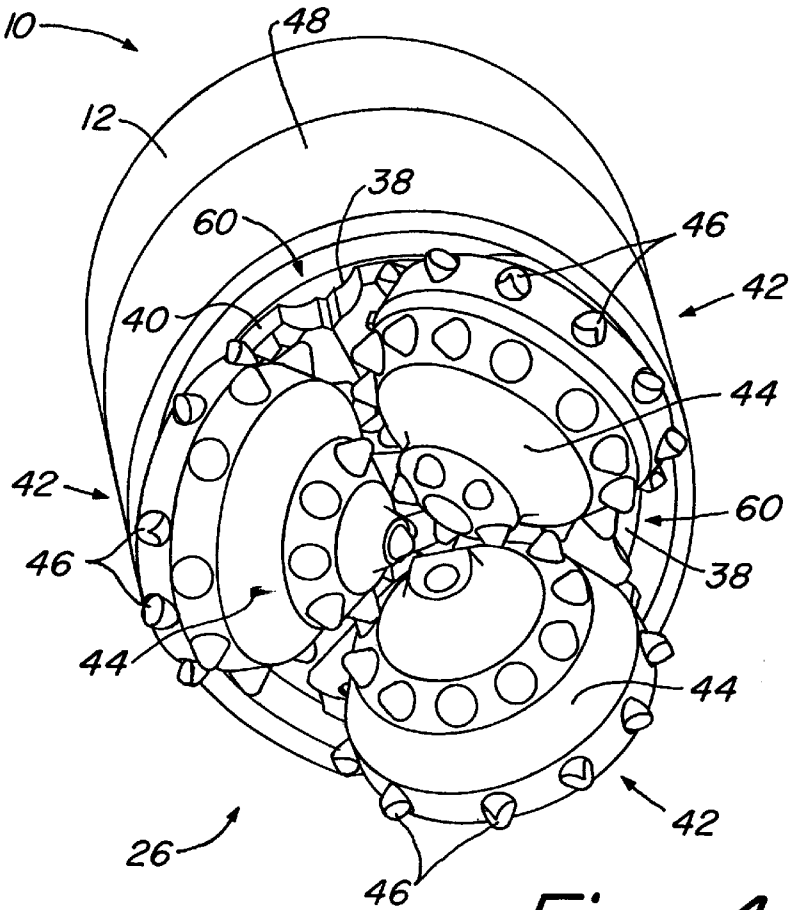
FIG. 4 is a perspective lower end view of the apparatus of FIG. 1.

Referring now to FIGS. 1–4, the drilling apparatus 10 is connected to the lower end of a dual passage drilling string 11 (FIG. 1*a*). Dual passage drilling string 11 has an outer drilling string 11*a* and an inner drilling string 11*b*, which define annular fluid passageway 11*c*. Dual passage drilling string 11 is secured to a lower sub or terminator 12. Sub 12 has a plurality of outer passages 16 which surround and are parallel to a central passage 19. Sub 12 has a lower end portion 20, which is of smaller outer diameter than the upper portions of sub 12. An annular recess 22 is formed on lower end portion 20, defining a downward facing shoulder 23. Outer passageways 16 have upper ends (not shown) which communicate with the annular passage 11*c* in the lower end of dual passage drilling string 11*a*. Outer passageways 16 terminate at shoulder 23 for transferring fluid from the drilling string annulus passage 11*c* to reduced outer diameter area 22. In a preferred embodiment, an area of larger diameter 24 is positioned lower portion 20 below the area of reduced diameter 22.

A bit body 26 is adapted to be detachably secured to sub 12. Bit body 26 preferably has three downwardly extending legs 28. Each leg 28 has a downwardly and generally radially inwardly extending cylindrical journal 30 (FIG. 1) which has an attached end 32 and a free end 34. Bit body 26 has a central passageway 36 in communication with central bore 19 for drilling fluid return. Bit body 26 additionally has three recesses 38, best seen in FIGS. 1, 3 and 4, defined on outer diameter 40 of bit body 26 between each of legs 28.

Three roller cutters 42 are positioned on each of legs 28. Each roller cutter 42 has a generally conical roller cutter body 44 having a plurality of cutting elements 46 attached thereto or formed thereon. Roller cutters 42 are mounted on each of legs 28 for rotation about a longitudinal centerline of journal 30.

A shroud 48 is affixed to sub 12 at threads 49. Shroud 48 surrounds an upper portion of bit body 26 and area of reduced diameter 22. Shroud 48 and area of reduced diameter 22 define shroud chamber 50 (FIG. 1). Shroud chamber 50 communicates with fluid passageway 16. Additionally, lower edge 54 of shroud 48 is chamfered with chamfer 56. Lower edge 54 is closely spaced to tapered upper area 58 (FIGS. 1 and 2) of legs 28 of bit body 26. Lower edge 54 defines fluid ports 60 at recesses 38. Preferably, fluid ports 60 have a greater circumferential dimension than a radial dimension.

In operation, drilling apparatus 10 is used to drill into rock formations. Drilling apparatus 10 is rotated by a swivel device (not shown). Cooling fluid, normally air, is circulated down fluid passageway 11*c* between the outer drilling string lla and inner drilling string 11*b*. The fluid passes through fluid passageways 16, through shroud chamber 50 and out of fluid ports 60. Cooling fluid then is directed over roller cutters 42 for cooling the roller cutters and eliminating debris therefrom. The fluid is then directed up central passageway 36 of bit body 26 and into central bore 19 of sub 12 where the fluid and cuttings are returned to the surface.

The invention has significant advantages. By forming fluid ports between recesses in the bit body and a shroud, larger ports are provided. Also, the ports have a greater circumferential extent than in the circular prior ports. This directs increased fluid flow across the bit cutters.

Although the invention has only been shown in only one of its forms, it should be apparent to those skilled in the art that it is not so limited but is susceptible to various changes without departing from the scope of the invention.

What is claimed is:

1. A rotary drilling apparatus, said drilling apparatus comprising:

a terminal end of a dual passage drilling string, the terminal end having a central bore, and at least one fluid passageway spaced from the bore and extending downward therethrough;

a bit body detachably secured to said terminal end of said drilling string, said bit body having three downwardly extending legs, each leg having a downwardly and generally radially inwardly extending cylindrical journal having an attached end and a free end, said bit body having a central passageway in communication with said central bore for drilling fluid return and a recess defined on an outer surface of said bit body between each of said legs;

three roller cutters, one for each leg, each roller cutter comprising a generally conical roller cutter body mounted on the respective leg for rotation about a longitudinal centerline of said journal, each of said roller cutters having a plurality of cutting elements on said roller cutter body; and a shroud affixed to said terminal end and surrounding an upper portion of said bit body, said shroud defining a shroud chamber which communicates with said fluid passageway, said shroud having a lower edge which is closely spaced to said legs of said bit body and which defines fluid ports at each of said recesses for delivery of fluid over the outer surface of said bit body at said recesses.

2. The rotary drilling apparatus according to claim 1 wherein said lower edge of said shroud is chamfered, inclining outward in a downward direction.

3. The rotary drilling apparatus according to claim 1 wherein said fluid ports have a greater circumferential dimension than a radial dimension.

4. The rotary drilling apparatus according to claim 1 wherein said shroud is secured by threads to said terminal end, and said lower edge of said shroud is free of contact with said bit body.

5. The rotary drilling apparatus according to claim 1 further comprising an area of reduced outer diameter on said terminal end above where said bit body secures to said terminal end.

6. The rotary drilling apparatus according to claim 1 wherein each bit leg has a tapered upper area that inclines outward in a downward direction at an angle relative to an axis of rotation of said bit body, and said lower edge of said shroud is chamfered at substantially the same angle as the tapered upper area, said tapered upper area being closely spaced to but free of contact with said chamfered lower edge of said shroud.

7. A rotary drilling apparatus, said drilling apparatus comprising:

a terminal end of a dual passage drilling string, the terminal end having a central bore, and at least one fluid passageway spaced from the bore and extending downward therethrough;

a bit body detachably secured to said terminal end of said drilling string, said bit body having three downwardly extending legs, each leg having a downwardly and generally radially inwardly extending cylindrical journal having an attached end and a free end, said bit body having a central passageway in communication with said central bore for drilling fluid return, said bit body having an outer surface with a tapered upper area on each of said bit legs that inclines outward in a downward direction relative to an axis of rotation of said bit body, and a recess defined on said outer surface of said bit body between each of said legs;

three roller cutters, one for each leg, each roller cutter comprising a generally conical roller cutter body mounted on the respective leg for rotation about a longitudinal centerline of said journal and a plurality of cutting elements on the roller cutter body; and a shroud affixed to said drilling string and surrounding an upper portion of said bit body defining a shroud chamber which communicates with said fluid passageway, said shroud having a chamfered lower edge which is closely spaced to said tapered upper area of said legs of said bit body and defining fluid ports at each of said recesses for delivery of fluid over said outer surface of said bit body at said recesses.

8. The rotary drilling apparatus according to claim 7 wherein said fluid ports have a greater circumferential dimension than a radial dimension.

9. The rotary drilling apparatus according to claim 7 wherein said shroud is secured by threads to said drilling string, and wherein said lower edge is free of contact with said outer surface of said bit body.

10. The rotary drilling apparatus according to claim 7 further comprising an area of larger outer diameter on said terminal end where said bit body secures to said terminal end, and an area of reduced outer diameter on said terminal end above said area of larger outer diameter.

11. The rotary drilling apparatus according to claim 7 wherein said chamfered lower edge is substantially at a same angle as said tapered upper area.

12. A method of providing fluid ports in a rotary drill bit comprising the steps of:

forming recesses on an outer surface of a drill bit body;

affixing said bit body to a terminal end of drilling string, said terminal end having at least one fluid passageway formed in a wall thereof;

affixing a sleeve to said terminal end and surrounding an upper portion of said bit body with said cylindrical sleeve; and closely spacing a lower edge of said sleeve to said outer surface of said drill bit body adjacent said recesses, thereby forming fluid ports between said recesses and said cylindrical sleeve.

13. The method according to claim 12, wherein said recesses are formed between bit legs of said bit body.

* * * * *

UNITED STATES PATENT AND TRADEMARK OFFICE

CERTIFICATE OF CORRECTION

PATENT NO. : 6,095,261

DATED : August 1, 2000

INVENTOR(S) : Joe trevino, Jr.

It is certified that error appears in the above-identified patent and that said Letters Patent is hereby corrected as shown below:

Column 2, line 19, between "positioned" and "lower portion", insert --on--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*